US005569083A

United States Patent [19]

Fioretti

[11] Patent Number: 5,569,083

[45] Date of Patent: Oct. 29, 1996

[54] METHODS AND APPARATUS FOR PLAYING BINGO OVER A WIDE GEOGRAPHIC AREA

[75] Inventor: Philip R. Fioretti, West Haven, Conn.

[73] Assignee: Millennium Investments Limited, Cyprus

[21] Appl. No.: 274,833

[22] Filed: Jul. 14, 1994

Related U.S. Application Data

[62] Division of Ser. No. 946,176, Sep. 16, 1992, Pat. No. 5,351,970.

[51] Int. Cl.[6] ..... A63F 9/24

[52] U.S. Cl. ..... 463/19; 463/40; 273/269

[58] Field of Search ..... 463/19, 40, 41; 273/139, 237, 269, 138 R, 138 A, 439

[56] References Cited

U.S. PATENT DOCUMENTS

| | | |
|---|---|---|
| 4,760,527 | 7/1988 | Sidley . |
| 4,848,771 | 7/1989 | Richardson . |
| 4,885,700 | 12/1989 | Kondziolka . |
| 4,909,516 | 3/1990 | Kolinsky . |
| 4,926,327 | 5/1990 | Sidley . |
| 5,007,649 | 4/1991 | Richardson . |
| 5,043,887 | 8/1991 | Richardson . |
| 5,072,381 | 12/1991 | Richardson . |
| 5,108,115 | 4/1992 | Berman et al. . |

FOREIGN PATENT DOCUMENTS

| | | |
|---|---|---|
| 2197971 | 6/1988 | United Kingdom . |
| 2214823 | 9/1989 | United Kingdom . |

OTHER PUBLICATIONS

Mega Bingo The Big One; Fact Sheet from Gamma International, Ltd. Feb. 1989.

*Primary Examiner*—Jessica Harrison
*Assistant Examiner*—Michael O'Neill
*Attorney, Agent, or Firm*—Joseph J. Kaliko

[57] ABSTRACT

Methods and apparatus (systems) are set forth for enabling bingo (and similar games of chance, referred to hereinafter collectively as "bingo") to be played in real time at locations which are remote (geographically separated in a physical sense) from the location where the numbers (or more generally symbols) used to play a bingo type of game are being selected. The disclosed methods and apparatus are directed to both passive and interactive systems which allow bingo to be played from the aforementioned remote locations.

27 Claims, 4 Drawing Sheets

METHODS AND APPARATUS FOR PLAYING BINGO OVER A WIDE GEOGRAPHIC AREA

This application is a division, of application Ser. No. 07/946,176, filed Sep. 16, 1992 U.S. Pat. No. 5,351,970.

BACKGROUND OF THE INVENTION

1. Field of the Invention

The invention relates generally to games of chance such as bingo and the like. More particularly, one aspect of the invention relates to methods and apparatus for enabling bingo (and similar games of chance, referred to hereinafter collectively as "bingo") to be played in real time at locations which are remote (geographically separated in a physical sense) from the location where the numbers (or more generally symbols) used to play a bingo type of game are being selected. Being able to play bingo in real time, at the aforementioned remote locations, is defined herein as the ability to play bingo over a "wide geographic area". A further aspect of the invention is directed to interactive systems which support playing bingo over a wide geographic area.

2. Description of the Prior Art

In bingo and similar games of chance the basic elements of the game are a gaming board (or card) and a random number (or symbol) generating device. The gaming board can be a square array of symbols (with the term "symbol" being defined herein to include numbers), usually a 5×5 numerical array, with the centermost location being blank or termed a "free space". The game is generally played with either 75 or 90 numbers. Each column in the array is usually limited to only one-fifth of the numbers, e.g., the first column numbers are taken from the group 1 to 15 in the event 75 numbers are used, and 1 to 18 if 90 numbers are used; the second column numbers are taken from the group 16 to 30 or 19 to 36, and so on. Further, duplicate numbers cannot appear on a gaming card.

When the game is being played, the game operator specifies a shape or pattern to be formed on the gaming card by randomly generated numbers (or other legal symbols), and then proceeds to call the symbols generated at random (such as, for example, the numbers between 1 and 75, or 1 and 90, etc.). If a symbol called coincides with one on a player's board, the player marks the symbol in some fashion on his board. The object of the game is to be the first player to have a set of randomly called symbols coincide with the marked symbols on the player's board so as to form the specified shape or pattern.

The specified shape or pattern may be an X, T, L, a diagonal line, five symbols horizontally or vertically, and so on. Several of these games, usually between twelve and eighteen, constitute a bingo program or session which is played during the course of an evening over several hours. The games are played consecutively and essentially without any major interruption except possibly for intermissions.

These games have long been played at churches, in schools, at bingo halls on Indian reservations, and at other centralized facilities, to raise money for charity or to profit the institution sponsoring the gaming session where gambling is legal.

The participants typically go to the central facility where the gaming session is to be held, pay an admission charge and purchase one or more game boards each having at least one fixed numerical array printed thereon.

In some instances it is difficult or impossible for individuals who would like to participate in a game of bingo to go to central facility where the bingo session is scheduled to be played. For example, there are instances where individuals are unable to secure transportation to the facility. In some cases, people who are confined to a hospital or nursing home cannot physically attend a bingo session. In still other situations, individuals are not able to leave their homes due to illness or other responsibilities and although they desire to participate in a bingo session, support a charitable event, engage in a participatory form of entertainment, etc., they are presently unable to do so. These problems exist because no methods and apparatus (systems) are presently known which support the playing of bingo like games over a wide geographic area.

Accordingly, it would be desirable to provide methods and apparatus for enabling bingo to be played in real time at locations which are remote from the location where the numbers (or other symbols) used to play a bingo type of game are being selected.

A further problem exists with the type of bingo games currently played at centralized facilities. These games have long been played with boards which have a fixed printed numerical array. Players select from a large number of preprinted boards and, therefore, are unable to create and play an array of their own choosing and determination.

While some games have been played with blank paper boards that are filled in with numbers (or other symbols) of the player's own choosing, the cards are limited in size and can essentially be used only once since the player marks out the numbers (or other symbols) called with an ink dauber or like, means. This type of random array selection results in an inefficiency of operation for playing consecutive games on a minimum interruption basis.

This inefficiency affects not only the game operator, who must find and check a copy of the marked paper boards which are collected to avoid an unauthorized change in the numbers (or other symbols) once the game has started, but also the player, who must prepare a new board prior to each game. These actions require time and detract from the desired even, and essentially uninterrupted, flow of a successful bingo program. It is mainly for these reasons that the blank board approach has been used only for single games and then generally only for the first game of the bingo program.

Another important consideration when playing bingo at either a central facility or from remote locations is to provide a gaming board which cannot be changed without the knowledge of the game operator, which provides an indication that it was acquired for use in the particular program being conducted, and which can be checked quickly in the event a winning combination occurs on a board.

Furthermore, during a typical bingo program, the shape of the winning array generally varies from one game to the next and players having several cards to "mark" may loose track of numbers (or other symbols) called or may not be responsive enough in their marking effort to keep up with the progress of the game. Therefore, it may be desirable for the player to be provided with an automatic indication of when a match of the pattern being played for has occurred in one of the game arrays that have been sold.

Recently, electronic gaming boards have been developed which permit a player to select his own numbers and to display the shape of a winning array. These boards signal the player when a winning array has been achieved on his board. An electronic gaming board of this type is more fully described in U.S. Pat. No. 4,365,810, issued to John Richardson on Dec. 28, 1982. Other advantageous electronic gaming systems and components thereof are described in U.S. Pat. Nos. 4,848,771, 5,007,649 and 5,043,887, all issued in the name of John Richardson; and U.S. Pat. No. 5,072,381, issued in the name of Richardson et al. These patents are all hereby expressly incorporated by reference.

U.S. Pat. No. 4,848,771, to Richardson, entitled "Gaming System With Session Master And Gaming Boards", issued Jul. 18, 1989, describes an automatic gaming system for games of chance, employing electronic game boards in conjunction with a system base station for downloading game card arrays into the electronic game board units, and validation units.

The game card arrays are downloaded into the electronic game boards during an initialization process in which the base station creates a gaming schedule, including win pattern definitions, pay out levels, etc. The validation units are also initialized by the base station and are used to check win claims by physically coupling a validation unit to an electronic game board and checking a validation code originally downloaded to both units by the base station.

U.S. Pat. No. 5,007,649, to Richardson, entitled "Gaming System With System Base Station And Gaming Boards", issued Apr. 16, 1991, describes an electronic gaming system that includes a base station capable of downloading game card arrays into an electronic game board. The game cards are stored in the base station as a gaming card library. The 24 numbers (or symbols) for each array, ranging from 1 to 75 (or 1 to 90), are packed into 12 bytes. In a total of 600,000 bytes, 50,000 gaming cards are stored, each 12 bytes long.

U S Pat. No. 5,043,887 to Richardson, entitled "Automatic Downloading Of Bingo Cards", issued Aug. 27, 1991, describes a gaming system that employs a base station, including game card array production means, and a plurality of gaming boards designed to exchange information with the system base station (via a cable connection to a communications port physically included as part of the base station means), store game card arrays downloaded from the base station, and means for actually playing the game as numbers are selected.

U.S. Pat. No. 5,072,381, to Richardson et al., entitled "Automatic Downloading Of Bingo Cards With Algorithm For Generating Bingo Cards", issued Dec. 10, 1991, describes an electronic gaming system including a base station which stores game card arrays in individual records as a gaming card library, and which employs an algorithm to generate cards which ensures that numerical arrays of consecutive adjacent gaming arrays in the library, differ by more than one array entry.

None of the aforementioned patents is directed to methods and apparatus which permit a bingo like game to be played over a wide geographic area. In fact, all of the aforementioned patents teach away from such a system. It should be noted, for example, that the initialization and win verification procedures described in the incorporated references require that the electronic game boards, the verification units and the system base station means, all (at different times) be physically coupled to one another via detachable cable connections made at the central facility where the bingo session is being held. This is necessary so that these units can be operated in accordance with the teachings set forth in the incorporated reference.

For example, a cable must be attached to each electronic game board and must be plugged into the system base station, for the electronic game board to accept game card arrays and instructions downloaded from the system base station; the verification units must be physically coupled via a cable to each winning electronic game board (after a win is signalled) to verify that a genuine winning array has been sold, etc.

Furthermore, the electronic bingo system contemplated by the incorporated references requires the use of expensive components, such as the electronic game boards and verification units per se, which because of their cost do not lend themselves to being safely and securely removed from the central facility. Such units would be expensive to replace if lost, stolen or damaged.

Still further, the electronic bingo system components taught in the incorporated references would be expensive for the average game participant to purchase if used in playing bingo from, for example, a participant's home, assuming the communications and security problems associated with using such equipment to play bingo over a wide geographic area could be solved. These problems include, for example, competition for communications resources when downloading information to the electronic game boards, keeping track of inputs to a centralized base station by participants as a game is being played, detecting tampering of the data in or electronics associated with a given electronic game board, physically performing the win verification functions suggested by the incorporated references over a wide geographic area, etc.

For all of the aforementioned reasons, the type of systems described in the incorporated references, although illustrating the state of the art and teaching the components of an electronic bingo system (including electronic game boards, win verification units and centralized base station means capable of sequencing through a bingo game session, creating and storing game card arrays, downloading such arrays upon request, etc.), do not teach methods or apparatus suitable for playing bingo over a wide geographic area.

The present state of the art regarding games of chance which can be played from remote locations on an interactive basis may be illustrated by U.S. Pat. Nos. 4,760,527, and 4,926,327, both to Sidley, entitled "System For Interactively Playing Poker With A Plurality Of Players" (issued Jul. 26, 1988), and "Computerized Gaming System" (issued May 15, 1990), respectively. These patents, hereby incorporated by reference, describe an electronic system for playing a card game of poker which permits interactive wagering among a plurality of players.

The system taught by Sidley exemplifies an interactive network which allows a plurality of players to compete against one another. However, only a limited number of players are allowed to compete at any one time (52 in total), and the teachings of Sidley require that all players be interconnected via a plurality of consoles (one for each player) which are all coupled to a central computer unit. The communications problems inherent in physically interconnecting a large number of players (hundreds or even thousands of players) to compete in real time, are serious; particularly if all the players compete for system resources within a short time window, such as the time interval between when numbers (or other symbols) are called during a bingo game.

Furthermore, the interactive systems taught in the Sidley references do not support the playing of a bingo like game per se.

For these reasons, although Sidley describes an interactive gaming system, the system is not suitable for supporting the playing of bingo over a wide geographic area on either a passive or interactive basis.

Finally, it should be noted that commercially available point of sale units for selling games of chance from remote locations presently exist, such as those manufactured by General Instrument Corporation, and are suitable for engaging in on-line communications with a centralized computing system that maintains records of a game of chance, in particular lottery games.

Using such on-line point of sale terminals, lottery tickets are commonly sold for playing "numbers" type games, such as picking a 3 digit number out of the 1,000 possible combinations of three digits, picking 6 out of 40 numbers, etc. The various combinations and permutations of selected numbers chosen by lottery players constitute bets which result in both either fixed or computed pay out levels usually determined by the number of tickets sold.

While such remote terminals are well known for procuring lottery tickets and offering such tickets to participants in a lottery drawing on either a "quick pick" basis (i.e., where the computer to which the terminal is coupled randomly generates the sequence of numbers to appear on the lottery ticket), and a "purchaser choice" basis (i.e., where the purchaser specifies the set of numbers that he or she is interested in playing); there is no known use of such a point of sale terminal to sell a bingo type game over a wide geographic area.

Accordingly, in addition to the other desirable aspects of methods and apparatus for playing bingo type games as set forth hereinabove, it would be desirable to provide a system (including methods and apparatus to perform the desired functions of such a system) that supports the playing of bingo type games, over a wide geographic area, which combines techniques and equipment for generating bingo game card arrays in response to a player's request for one or more game cards, with techniques and equipment used for the on-line generation of gaming tickets at a plurality of locations.

Furthermore, it would be desirable to provide a system that combines the aforementioned techniques and equipment for generating game card arrays in response to user requests, with techniques and equipment for keeping track of all arrays sold; and to further combine in such a system, methods and apparatus for sequencing through a bingo schedule (playing a set of bingo games), and for communicating the random symbols generated for each game in progress over a wide geographic area. Such a combined system would enable the participation in bingo games of people situated at locations other than the actual location where the symbols are being generated.

Still further, it would be desirable to provide at least one version of a system for supporting the playing of bingo over a wide geographic area, which is an "interactive" system. Such a system would contemplate user inputs while a bingo session is in progress. Furthermore, an interactive system would enhance the users overall entertainment from and participation in a game of bingo being played, particularly when compared to other passive types of games of chance, such as a lottery.

Further yet, it would be desirable to provide a system for playing bingo over a wide geographic area that enables players to play by subscription, i.e., where advance orders for game card arrays could be easily accommodated, along with sales from the aforementioned on-line point of sale terminals.

Yet another desirable aspect of a system that supports playing bingo over a wide geographic area would be a feature that allows an electronic version of the game to be played. That is, a system that utilizes the aforementioned electronic game boards, home computer terminals or cable television "boxes" and the like, for allowing game card array purchases to be made from remote locations and/or for playing bingo at such locations without having to utilize printed game cards. Such a system, combined with the aforementioned interactive type of system contemplated by one embodiment of the invention, could even be designed to facilitate the exchange of game card arrays during the progress of a game.

SUMMARY OF THE INVENTION

Accordingly, it is a primary object of the invention to provide methods and apparatus for enabling bingo to be played in real time at locations which are remote from the location where the numbers (or other symbols) used to play a bingo type of game are being selected (i.e., over a "wide geographic area" as defined herein).

It is a further object of the invention to provide methods and apparatus for enabling bingo to be played in real time over a wide geographic area which can optionally provide a player at a remote site with an automatic indication of when a match of the pattern being played for has occurred on a valid game card array.

It is a still a further object of the invention to provide methods and apparatus for enabling bingo to be played in real time over a wide geographic area which optionally allows players to create and play arrays of their own choosing and determination.

Yet another object of the invention is to provide methods and apparatus for enabling bingo to be played in real time over a wide geographic area which combines techniques and equipment for generating bingo game card arrays in response to a player's request for one or more game cards, with techniques and equipment used for the remote on-line point of sale generation of gaming tickets.

A still further object of the invention is to provide a system that combines the aforementioned techniques and equipment for generating game card arrays in response to user requests, with techniques and equipment for keeping track of all arrays sold; and to further combine in such a system, methods and apparatus for sequencing through a bingo schedule (playing a set of bingo games), and for communicating each game in progress over a wide geographic area.

Further yet, it is an object of the invention to provide at least one version of a system for supporting the playing of bingo over a wide geographic area, which is an "interactive" system, i.e., a system that contemplates and responds to preselected user inputs while a game of bingo is in progress and/or before or after a game is completed.

Still further, it is an object of the invention to provide a system for playing bingo over a wide geographic area that enables players to subscribe to a series of bingo sessions by making advance purchases of game card arrays.

Finally, it is yet another object of the invention to provide a system for playing bingo over a wide geographic area using an "electronic" version of the game, defined as a system that utilizes the aforementioned electronic game boards, home computer terminals or cable television "boxes", and the like, for making game card array purchases from remote locations and/or for playing bingo at such locations without having to utilize printed game cards.

In accordance with one aspect of the invention, a system for enabling bingo to be played over a wide geographic area is described, comprising: (a) means for issuing game card arrays in response to purchase requests; (b) means for keeping track of all game card arrays issued in response to said purchase requests; (c) means for sequencing through each bingo game in a scheduled bingo session; and (d) means for communicating over a wide geographic area the sequence of random symbols being generated during a particular bingo game to thereby enable players over the wide geographic area to participate in the bingo session.

According to a specific illustrative embodiment of the invention, methods and apparatus are set forth which facilitate the purchase of bingo "cards" from at least one game card array on-line point of sale outlet. Such outlets may be set up at convenient locations, such as grocery stores, in liquor stores, and the like, to enable purchasers to easily obtain game cards for a scheduled game session.

Furthermore, according to this illustrative embodiment of the invention, each point of sale outlet is coupled to a central game station (also referred to herein as a system base station means) which, for example, may be coupled to the point of sale outlet by telephone lines. The central game station, in addition to other functions to be described hereinafter, may be used to keep track of the game array appearing on each card that is sold.

The central game station, in accordance with the aforementioned illustrative embodiment of the invention, also includes means for sequencing through a predefined gaming schedule, means for playing each scheduled game and means for terminating a given game upon determining that at least one game card array from the set of all cards sold is a winning game card array.

Still further, according to this first aspect of the invention, game participants, once purchasing a desired number of game card arrays, may participate in each game by viewing or listening to the game in progress from their homes or other remote locations (remote with respect to the point of sale outlet and the physical location of the central game station), by, for example, tuning in a preselected standard television channel, cable television channel, radio station or other means of communicating the progress of a game being played over a wide geographic area.

Any one or more of the aforementioned means of communicating the progress of a game over a wide geographic area may be included within or be coupled to the central game station, depending on the particular design of a given gaming system.

Participants in a given gaming session may then, by following the progress of a given game, mark their "cards" as each game is played, "covering" each symbol generated that appears on a given card. A winning card can be recognized by the participant when a predetermined shape or pattern, which is the object of the game, is reproduced on a card as a result of covering the symbols that have been generated.

As indicated hereinbefore, in one embodiment of the invention the central game station keeps track of all game card arrays, identifies the first game card (or set of game cards) on which the shape or pattern appears that is the object of the game appears, and signals that a winning card (or cards) has been sold, terminating the game.

According to this embodiment of the invention, a winner might not be required to participate in the game as it is being played in order to have a valid winning game card; in alternate embodiments of the invention, the winner may be required to register a winning card over an interactive data link (for example, a phone line coupled to the central computing system), and claim a prize within a pre-specified time limit (for example, before the next number or other legal symbol is generated), or else forfeit the prize with the game continuing.

According to a further alternate embodiment of the invention, an interactive network on which to play bingo is contemplated, wherein the network includes means for purchasing game card arrays from a remote location, and means for engaging in two way communications with the central game system to record selected symbols, to signal a winning game card array and/or to validate a winning game card array as being genuine. Still further alternate embodiments of the invention contemplate the use of electronic gaming systems, including electronic game boards and the like, for playing bingo like games over either a passive or interactive network.

In addition to the aforementioned systems and apparatus, the invention encompasses methods for playing bingo over a wide geographic area, such as a method comprising the steps of: (a) issuing game card arrays in response to purchase requests; (b) keeping track of all game card arrays issued in response to said purchase requests; (c) sequencing through each bingo game in a scheduled bingo session; and (d) communicating over a wide geographic area the sequence of random symbols being generated during a particular bingo game to thereby enable players over the wide geographic area to participate in the bingo session.

The invention features methods and apparatus for enabling bingo to be played in real time at locations which are remote from the physical location where the numbers (or other symbols) used to play a bingo type of game are being selected.

Furthermore, the invention features systems that allow bingo to be played on either a passive or interactive basis over a wide geographic area.

Still further, the invention features methods and apparatus which enable bingo to be played in real time over a wide geographic area and optionally allow players to create and play arrays of their own choosing and determination.

These and other objects, embodiments and features of the present invention and the manner of obtaining them will become apparent to those skilled in the art, and the invention itself will be best understood by reference to the following detailed description read in conjunction with the accompanying Drawing.

DETAILED DESCRIPTION

Figure 1:
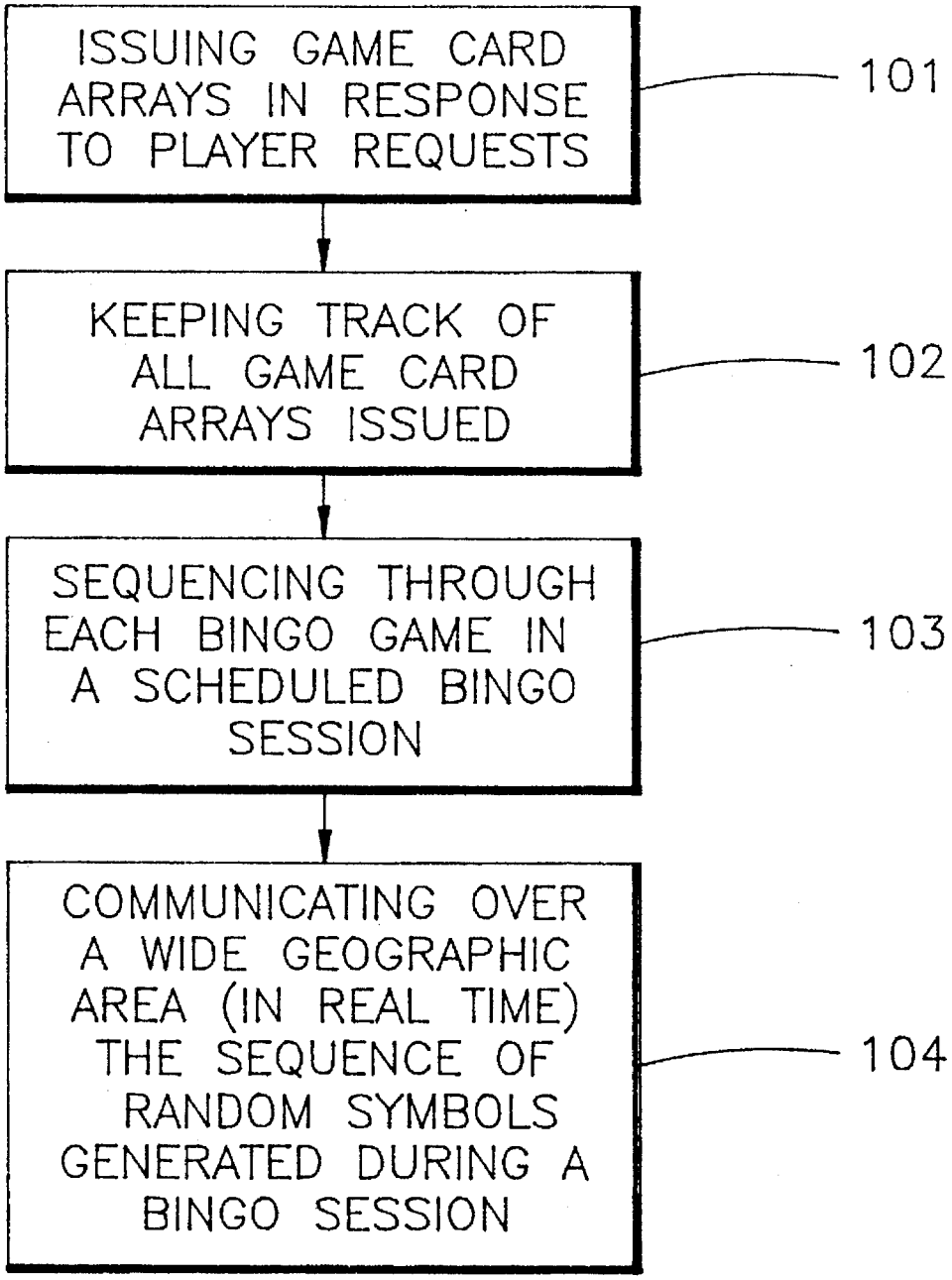
FIG. 1 depicts, in the form of a flowchart, one method which, in accordance with the teachings of the invention, facilitates the playing of bingo over a wide geographic area.

Reference should be made to FIG. 1 which depicts, in the form of a flowchart, one method that, in accordance with the teachings of the invention, facilitates the playing of bingo over a wide geographic area.

The illustrative method steps are shown at blocks 101–104 of FIG. 1, as follows: (a) issuing game card arrays in response to purchase requests, shown at block 101; (b) keeping track of all game card arrays issued (in response to said purchase requests), shown at block 102; (c) sequencing through each bingo game in a scheduled bingo session, shown at block 103; and (d) communicating over a wide geographic area (in real time) the sequence of random symbols being generated during a particular bingo game (shown at block 104), to thereby enable players over the wide geographic area to participate in the bingo session.

As indicated hereinbefore, according to one embodiment of the invention, the invention contemplates issuing (selling) bingo game card arrays (sometimes referred to herein as "cards") in response to purchaser requests using commercially available, on-line point of sale terminal outlets. Such outlets, like those presently in use for selling and printing lottery type tickets as discussed hereinabove, may be set up at convenient locations, such as grocery stores, in liquor stores, and the like, to enable purchasers to easily obtain game cards for a scheduled game session.

The only substantive modification needed to existing equipment for selling lottery tickets (to print bingo cards instead) would be to print game card arrays being issued, in the form of a bingo card matrix. This is well within the ability of those skilled in the art since the aforementioned commercially available devices for selling and printing lottery tickets presently have the ability to print sufficient characters on a single ticket (including validity information in the form of a serial number and other characters), to effectively issue (print) a bingo game card matrix.

Furthermore, it is presently well known to couple each of the point of sale terminals referred to hereinabove, (those presently used for the sale of lottery tickets), to a central gaming station (system base station means), which keeps track of all lottery tickets issued. The same type of commercially available central processing equipment (typically a digital computing system), to which such terminals are coupled, may be used to keep track of all bingo game card arrays issued, particularly in light of teachings in the incorporated Richardson patents which are directed to storing and keeping track of such arrays.

It should be noted that utilizing the technology incorporated in the state of the art on-line point of sale terminals referred to hereinabove (for selling lottery tickets), and the technology included in the point of sale terminals included as part of the base station means described in the incorporated Richardson patents (for generating and downloading bingo game card arrays per se), those skilled in the art can readily provide bingo game participants with the ability to choose numbers of their own determination, or defer to the base station means to make bingo card selections which are either randomly generated or stored in a system library.

Furthermore, according to an illustrative embodiment of the invention, each point of sale outlet may be coupled to the central game station via telephone lines and commercially available modems, making two types of point of sale outlets available to perspective bingo game participants, namely (1) point of sale outlets which are remotely coupled to a central game station which is not physically located (in a geographic sense) in the same place as the point of sale terminal (using for example, as indicated hereinabove, telephone lines to interconnect the terminal and station); and (2) "Richardson type" point of sale terminals (described in the incorporated references) which are included as part of the central game station itself (Richardson's system base station means).

In accordance with the illustrative embodiment of the invention being set forth herein, the central game station (system base station means) also includes means for sequencing through (and playing) each game in a predefined gaming schedule. The methods and apparatus for performing this function are also known to those skilled in the art, with an illustrative example being set forth in the incorporated Richardson patents with reference to Richardson's system base station means (a microprocessor controlled system) and his validation units.

Still further, according to the present invention, game participants, once purchasing a desired number of game card arrays, participate in each game by viewing or listening to the game in progress from their homes or other remote locations (remote with respect to the point of sale outlet and the physical location of the central game station), by, for example, tuning in a preselected standard television channel, cable television channel, radio station or other means of communicating the progress of a game being played over a wide geographic area.

This aspect of the invention relies on the use of well known techniques for communicating over a wide geographic area; however, what is new is the utilization of such techniques as part of a combined system of elements (and/or method steps) for playing bingo over a wide geographic area, i.e., communicating the sequence of symbols generated, or otherwise determined during the course of playing a game of bingo, in real time to locations that are wide spread and/or physically different from the location where the sequence of symbols is being generated.

As indicated hereinbefore, any one or more of the aforementioned means of communicating the progress of a game over a wide geographic area may be included within or be coupled to the central game station, depending on the particular design of a given gaming system.

Participants may play bingo during a given gaming session being conducted on a system which employs the aforementioned illustrative method steps, by simply following the progress of a given game, marking their "cards" as each game is played, and "covering" each symbol generated that appears on a given card.

Electronic means may also be utilized (but are not required to be used) for keeping track of the progress of the bingo games in a scheduled session. Where such devices are used (such as the electronic game boards described by Richardson in the incorporated references, game boards stored in PCs, etc.), the invention contemplates either selling (issuing) game card arrays over a communications path coupled from the site where a player is located (e.g., his or her home) to the system base station means (using, for example, a phone line, cellular link, cable link and associated cable "box", etc.); and/or issuing game card arrays at a game card array sales site, by "charging up" and electronic device in much the same way as a postage meter is initialized, i.e. by bringing the electronic game board (or storage media associated therewith) to an on-line point of sale terminal (for example, either of the two types of terminals referred to hereinabove; so long as they have the appropriate interfaces, such as those taught in the incorporated Richardson references, for downloading purchased game card arrays).

A winning card can be recognized by the participant (for example, visually or tactilely in the case of game card arrays containing symbols in braille, etc.) when a predetermined shape or pattern, which is the object of the game, is reproduced on a card as a result of "covering" the symbols that have been generated. In such cases the player could submit a winning bingo game card array for payment in much the same manner as winning lottery tickets are presented for payment. In such cases a validity check would typically be performed to insure that the card sold was genuine and recorded (kept track of) by the system, a check would be made that indeed the card is a winning card, and payment would then be made.

The participant, according to an alternate embodiment of the invention, could also be alerted to a winning array by electronic means, such as an electronic game board of the type taught by Richardson in the incorporated references.

Even the system itself, according to yet another embodiment of the invention, could be used to signal the existence of a winning game card by exhaustively checking all issued game card arrays for winning arrays (utilizing, for example, the pattern recognition teachings described in the incorporated Richardson patents, or other such techniques), during the period between the generation and communication of successive randomly generated symbols.

As indicated hereinbefore, in one embodiment of the invention the central game station keeps track of all game card arrays, identifies (verifies) the first game card (or set of game cards) on which the shape or pattern that is the object of the game appears, and signals that a winning card (or cards) has been identified, terminating the game. Suitable examples of methods and apparatus for keeping track of symbols generated, identifying (verifying) arrays which have win patterns thereon based on a schedule of games, and signalling a winning array, are all discussed in the incorporated Richardson references and will therefore not be described further herein.

According to embodiments of the invention where the system determines the winning game card array, a player would not necessarily be required to participate in the game as it is being played in order to be a winner. Such a game is defined herein as being played on a "passive" system. An example of a passive system contemplated by the invention will be described hereinafter in detail with reference to FIGS. 2–3.

In an alternate embodiment of the invention, the winner may be required to register a winning card over an interactive data link (for example, a phone line coupled to the central computing system), and claim a prize within a pre-specified time limit (for example, before the next number or other legal symbol is generated), or else forfeit the prize with the game continuing. Such a system (defined herein as one form of an "interactive" system for playing bingo over a wide geographic area) will be described hereinafter with reference to FIG. 4.

In this type of system (interactive), pattern recognition (visual, electronic, etc.), could be conducted at the site where a participant is playing the game. Upon detecting a win, only the serial number (for example) or other information identifying a particular array sold would need to be input to the system base station means (over any one of a number of well known types of communications paths, such a phone line, etc.); whereupon the system base station means would only have to verify (validate) that a win pattern exists on the particular game card array identified; rather than having to examine each and every game card array being tracked by the system to assess whether or not a win has occurred after a given random symbol has been generated and "called".

Furthermore, if electronic means are utilized to keep track of the progress of a game, validation units, such as those taught in the aforementioned incorporated Richardson patents, could be used to verify wins and upload the pertinent information to the system base station means to bring a given game to a close.

Figure 2:
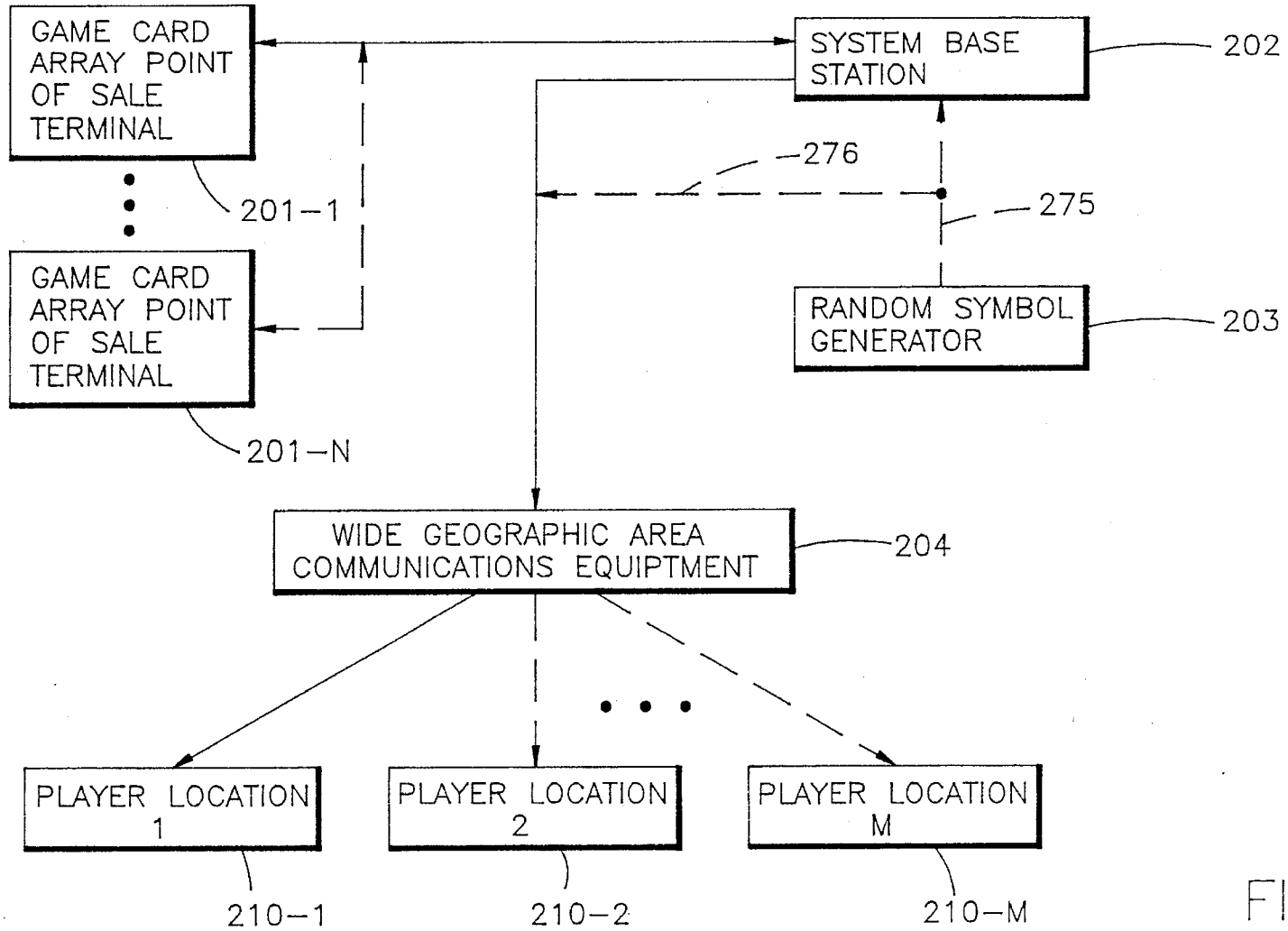
FIG. 2 depicts, in the form of a functional block diagram, one system which, in accordance with the teachings of the invention, is suitable for playing of bingo over a wide geographic area.

Reference should now be made to FIG. 2 which, as indicated hereinabove, depicts (in the form of a functional block diagram), one system (a passive system as defined herein) which, in accordance with the teachings of the invention, is suitable for playing of bingo over a wide geographic area; and to FIG. 3 which depicts a more detailed illustrative version of the system base station depicted in FIG. 2.

FIG. 2 illustrates a preferred embodiment of the invention in which a point of sale terminal and the system base station means are separate units, shown, for example, at blocks 201-1 and 202, respectively. As indicated herinabove, these two units could be combined in the form of the system base station point of sale unit taught by Richardson in the incorporated patents. The separate units are preferred to allow game card array sale sites to be located over the geographical area where the game of bingo is to be played, making purchasing tickets more convenient for perspective participants. In particular, FIG. 2 shows other game card array point of sale terminals (e.g., terminal 201-n and other terminals indicated by the three dots), which are presumably distributed over a predefined geographic area, optionally coupled to system base station 202.

The preferred embodiment of the invention is also one that does not require (but does not necessarily exclude) the utilization of electronic equipment located at the site where the participant will play the game. This preferred embodiment of the invention is meant to accommodate people who do not want to buy or rent expensive equipment to participate in a game of bingo; and avoid using or tying up communications equipment and resources (such as a telephone line) that would be needed to exchange information between remotely coupled electronic units and a centralized gaming station.

In addition to game card array point of sale terminal 201 and system base station means 202, FIG. 2 depicts random symbol generator 203, shown interconnected to system base station means 202 and/or wide geographic area communications means 204, via dashed links 275 and 276. A dashed link is used since in alternate embodiments of the system contemplated by the invention (1) system base station means 202 may actually include a random symbol generator of its own; (2) the symbols generated by random symbol generator 203 may simply be input (from an external source) to system base station means 202 (over, for example, dashed link 275); or (3) the symbols generated by random symbol generator 203 may, in addition to being input to the system base station means 202, be directly coupled (over link dashed 276) to communications equipment 204. All of these variations of the system configuration described hereinabove, are contemplated by the invention.

FIG. 2 goes on to depict communications equipment 204, which is designed to keep players at remote locations (such as player location 1, designated by block 210-1 in FIG. 2), informed (in real time) of the sequence of random symbols generated during the course of each game. According to the invention, players could be located at a plurality of locations (shown as locations 210-2 thru 210-M in FIG. 2), and all be simultaneously kept informed of the progress of each game.

It should be noted that a standard broadcast television system, cable television system, satellite system, radio channel, telephone link or other commercially available means of communicating the progress of a game being played over a wide geographic area, may be used to realize the wide geographic area communications equipment depicted at block 204 in FIG. 2.

The passive system depicted in FIG. 2 would not require any player feedback to the system base station as a given game of bingo is being played. This is because the system base station means would simply bring each game to a conclusion when it determined that a winning pattern existed on a game card array that was sold.

A list of winning serial numbers could, for example, be broadcast or published in local newspapers, etc., at any time following the conclusion of a given game. Players holding winning game card arrays (in the form of paper tickets, arrays stored in electronic game boards, etc.) could then simply present their winning card(s) for verification and payment in the manner presently used to cash lottery tickets, or in the manner taught in the incorporated Richardson patents where electronic game boards are being used.

Figure 3:
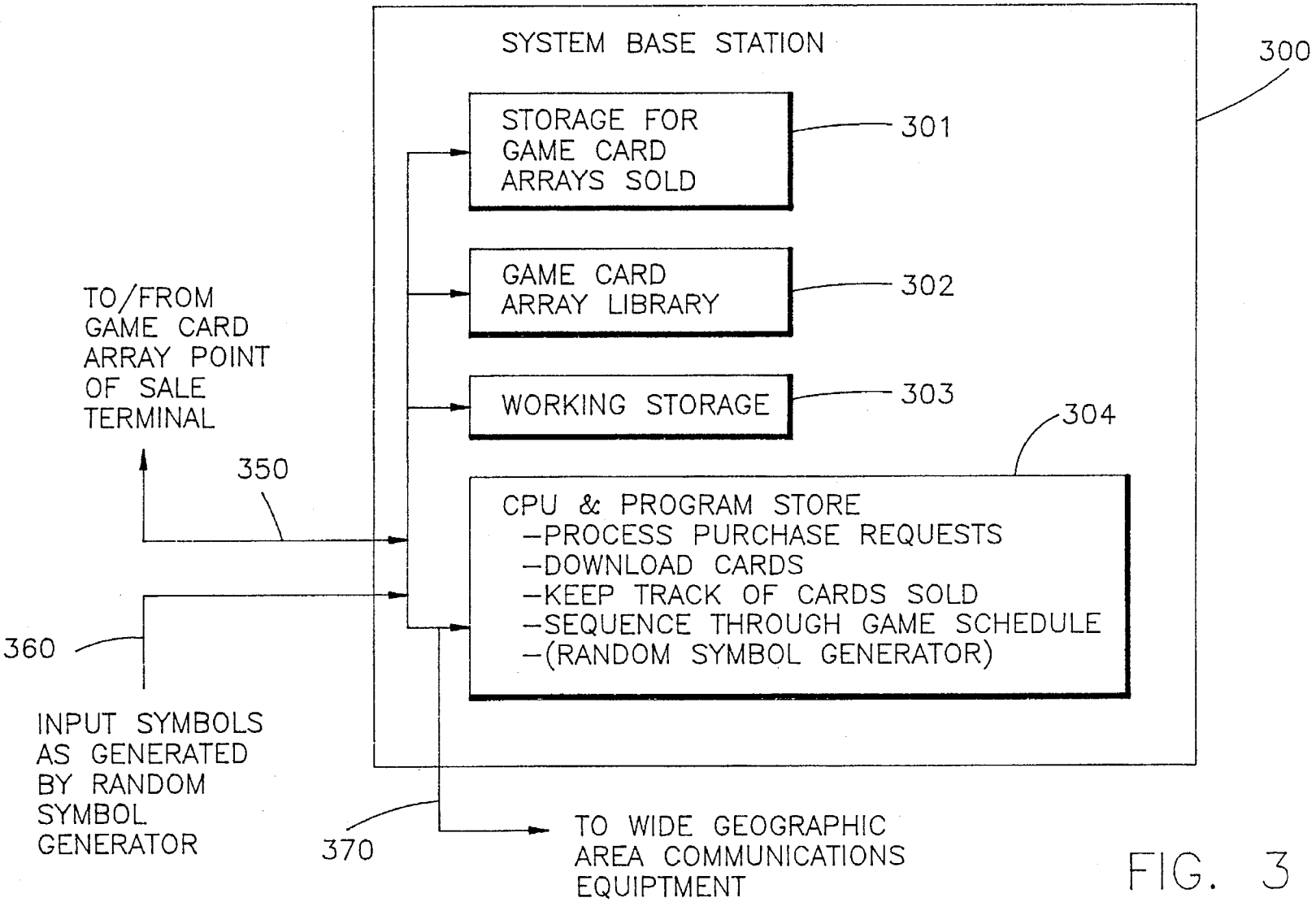
FIG. 3 depicts a more detailed illustrative version of the system base station depicted in FIG. 2.

Reference should now be made to FIG. 3 which, as indicated hereinbefore, presents a more detailed view of an illustrative version of the system base station depicted in FIG. 2.

In particular, FIG. 3 shows base station 300 (which could be used as base station 202 in FIG. 2), to include, storage for game card arrays sold (at block 301); a game card array library (at block 302); working storage (at block 303); and a CPU (and associated program storage), shown at block 304, for processing game card array purchase requests, downloading purchased game cards, keeping track of all game card arrays sold, and sequencing through each scheduled game.

A random symbol generator is optionally shown to be included in system base station means 300. When no such means is included (as discussed hereinabove), the symbols generated by an external random symbol generator would at some time need to be input to the system base station means to verify and/or identify winning game card arrays. This input is shown provided via link 360 in FIG. 3

Furthermore, link 350 is shown in FIG. 3, for providing the bidirectional communications path necessary to accept purchase requests and to accommodate the downloading of game card arrays being issued by base station means 300.

A link 370 is shown in FIG. 3, for providing the wide geographic area communication means with the sequence of randomly generated symbols when the generator is included as part of base station means 300.

Finally, FIG. 3 depicts CPU 304 (and the programs associated therewith) being coupled to storage elements (memory means) 301–303, described herinbefore, to allow the CPU to optionally perform at least the game playing and accounting functions taught in the incorporated Richardson patents.

As indicated hereinabove, the CPU 304 could, for example, be programmed (using techniques well known to those skilled in the art), to simply do a table look up of a game card array serial number (input following a given game), to find and verify a game card array, stored (for example) in storage element 301, as a winning array; CPU 304 could alternatively be programmed, for example, to perform an exhaustive search for a winning array each time a new symbol is generated during the course of a game, etc., the point being that the configuration depicted in FIG. 3 is powerful enough to accommodate any one of the aforementioned game playing scenarios on either a passive or interactive system utilizing programming techniques which are either explicitly described in the incorporated Richardson patents, variants thereof, and other techniques (such as simple table lookups, etc.) well known to those skilled in the art of programming digital computers.

Figure 4:
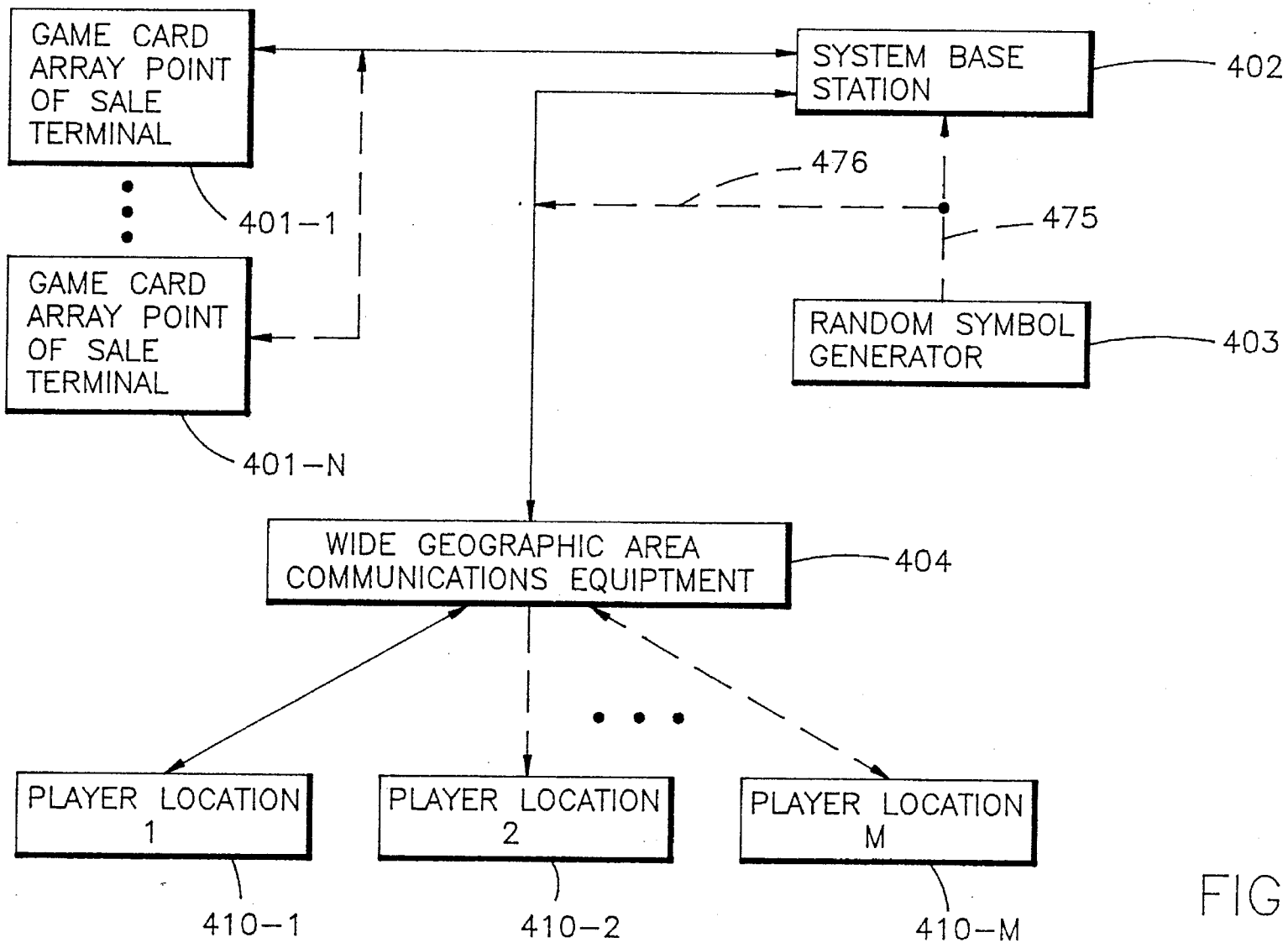
FIG. 4 depicts, in the form of a functional block diagram, an example of an interactive system which, in accordance with the teachings of the invention, is suitable for playing bingo over a wide geographic area.

An alternate embodiment of the invention is illustrated in FIG. 4 which, as indicated hereinbefore, depicts, in the form of a functional block diagram, an example of an interactive system that, in accordance with the teachings of the invention, is suitable for playing bingo over a wide geographic area.

FIG. 4 depicts the same system components as shown in FIG. 2, namely a set of game card array point of sale terminals (401-1 thru 401-N), system base station means 402, random symbol generator 403, wide area geographic communications equipment 404, and a set of M player locations (410-1 thru 410-M); interconnected in the same fashion described hereinabove with reference to FIG. 2 (for example, using dashed links 475 and 476 corresponding to dashed links 275 and 276 respectively from FIG. 2, etc.). However, double headed arrows are now shown on the communication paths between system base station 402 and wide geographic area communications equipment 404, and on the communication paths between at least some (but not necessarily all) of the remote player locations (such as locations 410-1 and 410-M) and wide geographic area communications equipment 404.

These bidirectional (or alternatively parallel but separate) paths, are intended to facilitate two way communications between system base station 402 and a given player location. For example, wide geographic area communications equipment 404 could include standard broadcast television equipment and the public telephone network, with a player signalling a win to system base station means 402 over a telephone link, and base station means 402 acknowledging the win using the broadcast television system, etc.

The system depicted in FIG. 4 is also capable of allowing a player to purchase game cards from his home by, for example, allowing a game card array purchase request to be communicated to the system base station. The purchase could be charged to a credit card, be charged to an account maintained by the player, etc.

The system depicted in FIG. 4 also would allow the system base station to download an array being issued directly to the player at a remote location.

To facilitate the aforementioned activities using the system depicted in FIG. 4, all that would be required is, for example, a bidirectional telephone link to be included as part of wide geographic area communications equipment 404, with the user having the appropriate modem(s) to facilitate communication with system base station means 402 over the phone lines. Downloaded game card arrays could, for example, be printed at the players remote location, game card arrays could be ordered from the remote locations and mailed to the player, game card arrays could be downloaded into electronic game board devices, etc.

Many variations of the passive and interactive systems described hereinabove can be appreciated by those skilled in the art. For example, interactive systems can be devised which do not accommodate play with electronic devices, while others allow for play using home based PC type devices, game boards such as those taught in the incorporated references, etc. Systems can be devised which allow for players to subscribe to a set of bingo sessions by mail, with the sessions being played at home. Still other systems can be devised which although detecting a winning game card array, continue play until a player signals a win thereby requiring participation in each game, etc.

What has been described in detail hereinabove are methods and apparatus meeting all of the aforestated objectives. As previously indicated, those skilled in the art will recognize that the foregoing description has been presented for the sake of illustration and description only. It is not intended to be exhaustive or to limit the invention to the precise form disclosed, and obviously many modifications and variations are possible in light of the above teaching.

The embodiments and examples set forth herein were presented in order to best explain the principles of the instant invention and its practical application to thereby enable others skilled in the art to best utilize the instant invention in various embodiments and with various modifications as are suited to the particular use contemplated.

It is, therefore, to be understood that the claims appended hereto are intended to cover all such modifications and variations which fall within the true scope and spirit of the invention.

What is claimed is:

1. A system for enabling bingo to be played over a wide geographic area, comprising:

(a) on-line point of sale terminal means for issuing valid game card arrays in response to purchase requests, at the time of request;

(b) means for keeping track of all game card arrays issued in response to said purchase requests;

(c) means for sequencing through each bingo game in a scheduled bingo session; and (d) means for communicating over a wide geographic area the sequence of random symbols being generated during a particular bingo game to thereby enable players at locations over the wide geographic area to participate in the bingo session.

2. A system for enabling bingo to be interactively played over a wide geographic area, comprising:

(a) on-line point of sale terminal means for issuing valid game card arrays in response to purchase requests, at the time of request;

(b) means for keeping track of all game card arrays issued in response to said purchase requests;

(c) means for sequencing through each bingo game in a scheduled bingo session; and (d) means for communicating over a wide geographic area the sequence of random symbols being generated during a particular bingo game to thereby enable players over the wide geographic area to participate in the bingo session; and (e) a communications path for allowing a game participant to interact with the system.

3. A gaming system for playing a game of chance over a wide geographic area, wherein said game requires a plurality of game card arrays, each formed from a plurality of symbols positioned in predetermined symbol display locations, and further wherein it is an object of the game to sequentially and randomly generate symbols from a predefined symbol universe, matching generated symbols against the symbols on said game card arrays, with a winner being declared whenever a predefined pattern of generated symbols is formed on at least one of said game card arrays, comprising:

(a) on-line point of sale terminal means for issuing valid game card arrays in response to purchase requests, at the time of request;

(b) means for keeping track of game card arrays in play;

(c) means for communicating over a wide geographic area the sequence of random symbols being generated during a particular game of chance to thereby enable players over the wide geographic area to participate in said game of chance; and (d) a communications path for allowing a game participant to interact with the system.

4. An interactive gaming system for playing a game of chance over a wide geographic area, wherein said game requires a plurality of game card arrays, each formed from a plurality of symbols positioned in predetermined symbol display locations, and further wherein it is an object of the game to sequentially and randomly generate symbols from a predefined symbol universe, matching generated symbols against the symbols on said game card arrays, with a winner being declared whenever a predefined pattern of generated symbols is formed on at least one of said game card arrays, comprising:

(a) on-line point of sale terminal means for issuing valid game card arrays in response to purchase requests, at the time of request;

(b) means for communicating over a wide geographic area the sequence of random symbols being generated during a particular game of chance to thereby enable players over the wide geographic area to participate in said game of chance; and (c) a communications path for allowing game participants to interact with the system when the game participants are physically located over a wide geographic area.

5. A gaming system for playing a game of chance over a wide geographic area, wherein said game requires a plurality of game card arrays, each formed from a plurality of symbols positioned in predetermined symbol display locations, and further wherein it is an object of the game to sequentially and randomly generate symbols from a predefined symbol universe, matching generated symbols against the symbols on said game card arrays, with a winner being declared whenever a predefined pattern of generated symbols is formed on at least one of said game card arrays, comprising:

(a) on-line point of sale terminal means for issuing valid game card arrays in response to purchase requests, at the time of request; and (b) means for communicating over a wide geographic area the sequence of random symbols being generated during a particular game of chance to thereby enable players over the wide geographic area to participate in said game of chance.

6. A method for enabling bingo to be played over a wide geographic area, comprising the steps of:

(a) issuing valid game card arrays in response to purchase requests, at the time of any such request, utilizing on-line point of sale terminal means;

(b) keeping track of all game card arrays issued in response to said purchase requests;

(c) sequencing through each bingo game in a scheduled bingo session; and (d) communicating over a wide geographic area the sequence of random symbols being generated during a particular bingo game to thereby enable players over the wide geographic area to participate in the bingo session.

7. A method for operating a gaming system for playing a game of chance over a wide geographic area, wherein said game requires a plurality of game card arrays, each formed from a plurality of symbols positioned in predetermined symbol display locations, and further wherein it is an object of the game to sequentially and randomly generate symbols from a predefined symbol universe, matching generated symbols against the symbols on said game card arrays, with a winner being declared whenever a predefined pattern of generated symbols is formed on at least one of said game card arrays, comprising the steps of:

(a) issuing valid game card arrays in response to purchase requests, at the time of any such request, utilizing on-line point of sale terminal means;

(b) keeping track of game card arrays in play;

(c) communicating over a wide geographic area the sequence of random symbols being generated during a particular game of chance to thereby enable players over the wide geographic area to participate in said game of chance; and (d) providing a communications path for allowing a game participant to interact with the system.

8. A method for operating a gaming system for interactively playing a game of chance over a wide geographic area, wherein said game requires a plurality of game card arrays, each formed from a plurality of symbols positioned in predetermined symbol display locations, and further wherein it is an object of the game to sequentially and randomly generate symbols from a predefined symbol universe, matching generated symbols against the symbols on said game card arrays, with a winner being declared whenever a predefined pattern of generated symbols is formed on at least one of said game card arrays, comprising the steps of:

(a) issuing valid game card arrays in response to purchase requests, at the time of any such request, utilizing on-line point of sale terminal means;

(b) communicating over a wide geographic area the sequence of random symbols being generated during a particular game of chance to thereby enable players over the wide geographic area to participate in said game of chance; and (c) providing a communications path for allowing game participants to interact with the system when the game participants are physically located over a wide geographic area.

9. A method for operating a gaming system for playing a game of chance over a wide geographic area, wherein said game requires a plurality of game card arrays, each formed from a plurality of symbols positioned in predetermined symbol display locations, and further wherein it is an object of the game to sequentially and randomly generate symbols from a predefined symbol universe, matching generated symbols against the symbols on said game card arrays, with a winner being declared whenever a predefined pattern of generated symbols is formed on at least one of said game card arrays, comprising the steps of:

(a) issuing valid game card arrays in response to purchase requests, at the time of any such request, utilizing on-line point of sale terminal means; and (b) communicating over a wide geographic area the sequence of random symbols being generated during a particular game of chance to thereby enable players over the wide geographic area to participate in said game of chance.

10. A system which enables a game of bingo to be played over a wide geographic area, comprising:

(a) on-line point of sale terminal means for issuing valid game card arrays in response to purchase requests, at the time of request;

(b) means for keeping track of all game card arrays issued in response to said purchase requests;

(c) means for sequencing through each bingo game in a scheduled bingo session; and (d) means for enabling each potential participant in a bingo session to play bingo without physically having to attend a pre-established gaming hall.

11. A system as set forth in claim 10 wherein said means for enabling is further operative to allow each participant in a bingo session to independently determine where to play bingo from a multiplicity of potential game participation sites other than pre-established gaming halls.

12. A system as set forth in claim 11 wherein said means for enabling further comprises means for communicating, over said wide geographic area, the sequence of random symbols being generated during a particular bingo game utilizing a communications channel that is accessible from each of said multiplicity of potential game participation sites located within said geographic area.

13. A system as set forth in claim 11 wherein a game participants home is included as one of said multiplicity of potential game participation sites.

14. A system as set forth in claim 12 wherein said means for communicating further comprises a broadcast television system.

15. A system as set forth in claim 12 wherein said means for communicating further comprises a cable television system.

16. A gaming system for playing a game of chance over a wide geographic area, wherein said game requires a plurality of game card arrays, each formed from a plurality of symbols positioned in predetermined symbol display locations, and further wherein it is an object of the game to sequentially and randomly generate symbols from a predefined symbol universe, matching generated symbols against the symbols on said game card arrays, with a winner being declared whenever a predefined pattern of generated symbols is formed on at least one of said game card arrays, comprising:

(a) on-line point of sale terminal means for issuing valid game card arrays in response to purchase requests, at the time of request; and (b) means for enabling each potential participant in said game to independently select, from a multiplicity of potential game participation sites within said area, where to play said game without having to physically attend a game participation site pre-established primarily for the purpose of playing bingo.

17. A gaming system as set forth in claim 16, further comprising means for sequencing through each bingo game in a scheduled bingo session.

18. A method for enabling bingo to be played over a wide geographic area, comprising the steps of:

(a) issuing valid game card arrays in response to purchase requests, at the time of any such request, utilizing on-line point of sale terminal means;

(b) keeping track of all game card arrays issued in response to said purchase requests;

(c) sequencing through each bingo game in a scheduled bingo session; and (d) enabling each potential participant in a bingo session to play bingo without physically having to attend a pre-established gaming hall.

19. A system as set forth in claim 1 wherein said on-line point of sale terminal means further comprises means for communicating said purchase requests to a remotely located system base station in order to register game card arrays as valid for play.

20. A system as set forth in claim 19 wherein at least one of said purchase requests includes data representing an array of numbers selected by a purchaser initiating a purchase request.

21. A system as set forth in claim 1 wherein said on-line point of sale terminal means is operative to register game card arrays being issued as valid for play.

22. A system as set forth in claim 1 wherein said on-line point of sale terminal means is operative to validate game card arrays for play in a given bingo game.

23. A system as set forth in claim 22 wherein said on-line point of sale terminal means further comprises means for printing validated game card arrays.

24. A method as set forth in claim 6 further comprising the step of communicating said purchase requests to a remotely located system base station in order to register game card arrays as valid for play.

25. A method as set forth in claim 24 wherein at least one of said purchase requests includes data representing an array of numbers selected by a purchaser initiating a purchase request.

26. A method as set forth in claim 6 wherein said step of issuing valid game card arrays further comprises the step of registering game card arrays being issued as valid for play.

27. A method as set forth in claim 6 wherein said step of issuing game card arrays further comprises the step of validating card arrays for play in a given bingo game.

* * * * *

UNITED STATES PATENT AND TRADEMARK OFFICE
Certificate

Patent No. 5,569,083 Patented: October 29, 1996

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Philip R. Fioretti, West Haven, Conn.; and Joseph J. Kaliko, Stamford, Conn.

Signed and Sealed this Sixth Day of October, 1998.

J. HARRISON, *SPE*
Art Unit 3711